US011628920B2

(12) United States Patent
Karnick et al.

(10) Patent No.: US 11,628,920 B2
(45) Date of Patent: Apr. 18, 2023

(54) SYSTEMS AND METHODS FOR STEERING A MARINE VESSEL

(71) Applicant: Brunswick Corporation, Mettawa, IL (US)

(72) Inventors: Kyle F. Karnick, Fond du Lac, WI (US); Andrew J. Przybyl, Berlin, WI (US); Kenneth G. Gable, Oshkosh, WI (US); David M. Van Buren, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 108 days.

(21) Appl. No.: 17/215,884

(22) Filed: Mar. 29, 2021

(65) Prior Publication Data

US 2022/0306260 A1 Sep. 29, 2022

(51) Int. Cl.

| | |
|---|---|
| ***B63H 25/00*** | (2006.01) |
| ***B63H 25/04*** | (2006.01) |
| ***B63H 25/24*** | (2006.01) |

(52) U.S. Cl.

CPC ..... *B63H 25/04* (2013.01); *B63H 25/24* (2013.01)

(58) Field of Classification Search

CPC ..... B63H 25/04; B63H 25/24
USPC ..... 701/21
See application file for complete search history.

(56) References Cited

U.S. PATENT DOCUMENTS

| | | | |
|---|---|---|---|
| 6,138,596 | A | 10/2000 | Gonring et al. |
| 6,230,642 | B1 | 5/2001 | McKenney et al. |
| 6,273,771 | B1 | 8/2001 | Buckley et al. |
| 6,405,669 | B2 | 6/2002 | Rheault et al. |
| 6,535,806 | B2 | 3/2003 | Millsap et al. |
| 6,655,490 | B2 | 12/2003 | Andonian et al. |
| 6,843,195 | B2 | 1/2005 | Watabe et al. |
| 6,883,451 | B2 | 4/2005 | Takada et al. |

(Continued)

FOREIGN PATENT DOCUMENTS

| | | |
|---|---|---|
| EP | 3578454 | 12/2019 |
| JP | 2739208 B2 | 4/1998 |

(Continued)

OTHER PUBLICATIONS

Boattest.com, Yanmar 8LV-ZT370 Joystick, web article, last accessed Nov. 7, 2016, available at http://www.boattest.com/enginereview/Yanmar/12500050_8LVZT370Joystick.

(Continued)

*Primary Examiner* — Tyler J Lee
*Assistant Examiner* — Tiffany P Ohman
(74) *Attorney, Agent, or Firm* — Andrus Intellectual Property Law, LLP

(57) ABSTRACT

A method of controlling a steering system on a marine vessel includes, in response to receiving a user input to engage a quick steer mode, employing a reduced steering ratio to translate positions of a steering wheel to desired steering angles of a marine drive. A vessel speed of a marine vessel is determined and then compared to a threshold vessel speed. An output limit is determined to prevent the marine vessel from further exceeding the threshold vessel speed while the quick steer mode is engaged. The marine drive is automatically controlled based on the output limit and a steering actuator associated with the marine drive is controlled based on the reduced steering ratio.

22 Claims, 6 Drawing Sheets

(56) References Cited

U.S. PATENT DOCUMENTS

| | | | | |
|---|---|---|---|---|
| 6,892,661 | B2 | 5/2005 | Kishi et al. | |
| 6,892,662 | B2 | 8/2005 | Mizuguchi et al. | |
| 6,994,046 | B2 | 2/2006 | Kaji et al. | |
| 7,004,278 | B2 | 2/2006 | Sugitani et al. | |
| 7,036,445 | B2 | 5/2006 | Kaufmann et al. | |
| 7,063,030 | B2 | 6/2006 | Mizutani | |
| 7,140,315 | B2 | 11/2006 | Okuyama | |
| 7,156,034 | B2 | 1/2007 | Mizutani | |
| 7,179,143 | B2 | 2/2007 | Mizuguchi et al. | |
| 7,267,069 | B2 | 9/2007 | Mizutani | |
| 7,267,587 | B2 | 9/2007 | Oguma et al. | |
| 7,270,068 | B2 | 9/2007 | Mizutani | |
| 7,311,572 | B2 | 12/2007 | Yamashita et al. | |
| 7,320,629 | B2 | 1/2008 | Okuyama | |
| 7,398,742 | B1 | 7/2008 | Gonring | |
| 7,404,369 | B2 | 7/2008 | Tracht et al. | |
| 7,422,496 | B2 | 9/2008 | Mizutani | |
| 7,452,250 | B2 | 11/2008 | Yazaki et al. | |
| 7,455,557 | B2 | 11/2008 | Mizutani | |
| 7,465,200 | B2 | 12/2008 | Mizutani | |
| 7,494,390 | B2 | 2/2009 | Mizutani | |
| 7,497,746 | B2 | 3/2009 | Okuyama | |
| 7,527,537 | B2 | 5/2009 | Mizutani | |
| 7,699,674 | B1 | 4/2010 | Wald et al. | |
| 7,769,504 | B2 | 8/2010 | Kaji | |
| 7,844,374 | B2 | 11/2010 | Mizutani | |
| 7,913,800 | B2 | 3/2011 | Graeve et al. | |
| 7,930,986 | B2 | 4/2011 | Mizutani | |
| 8,046,121 | B2 | 10/2011 | Mizutani | |
| 8,046,122 | B1 | 10/2011 | Barta et al. | |
| 8,113,892 | B1 | 2/2012 | Gable et al. | |
| 8,162,706 | B2 | 4/2012 | Mizutani et al. | |
| 8,182,396 | B2 | 5/2012 | Martin et al. | |
| 8,190,316 | B2 | 5/2012 | Kaji | |
| 8,376,792 | B2 | 2/2013 | Chiecchi | |
| 9,156,535 | B2 | 10/2015 | Mizutani | |
| 9,359,057 | B1 | 6/2016 | Andrasko | |
| 9,522,723 | B1 | 12/2016 | Andrasko | |
| 9,733,645 | B1 | 8/2017 | Andrasko et al. | |
| 9,809,292 | B1 | 11/2017 | Gonring | |
| 9,988,134 | B1 | 6/2018 | Gable et al. | |
| 10,232,925 | B1 * | 3/2019 | Gable | B63H 25/24 |
| 2005/0170713 | A1 | 8/2005 | Okuyama | |
| 2005/0199167 | A1 | 9/2005 | Mizutani | |
| 2005/0199169 | A1 | 9/2005 | Mizutani | |
| 2006/0180070 | A1 * | 8/2006 | Mizutani | B63H 25/02 114/144 R |
| 2007/0238370 | A1 | 10/2007 | Morvillo | |
| 2008/0189001 | A1 | 8/2008 | Morvillo | |
| 2010/0022146 | A1 | 1/2010 | Morvillo | |
| 2010/0116190 | A1 | 5/2010 | Ito | |
| 2010/0154697 | A1 | 6/2010 | Ito | |
| 2010/0191397 | A1 | 7/2010 | Nose et al. | |
| 2011/0166724 | A1 | 7/2011 | Hiramatsu | |
| 2012/0045951 | A1 | 2/2012 | Washino et al. | |
| 2012/0101670 | A1 | 4/2012 | Morvillo | |
| 2013/0096742 | A1 | 4/2013 | Nose et al. | |
| 2013/0273792 | A1 | 10/2013 | Davis et al. | |
| 2014/0174331 | A1 | 6/2014 | Hitachi et al. | |
| 2014/0202368 | A1 | 7/2014 | Morvillo | |
| 2014/0222260 | A1 | 8/2014 | Anson et al. | |
| 2015/0034001 | A1 | 2/2015 | Clarke et al. | |
| 2015/0192947 | A1 | 7/2015 | Clarke et al. | |
| 2016/0144941 | A1 | 5/2016 | Morvillo | |
| 2016/0221659 | A1 | 8/2016 | Wood et al. | |
| 2017/0029084 | A1 | 2/2017 | Burk et al. | |
| 2017/0029085 | A1 | 2/2017 | Burk et al. | |
| 2017/0121004 | A1 | 5/2017 | Clarke et al. | |
| 2017/0225761 | A1 | 8/2017 | Morvillo | |
| 2017/0247096 | A1 | 8/2017 | Morvillo | |
| 2017/0283027 | A1 | 10/2017 | Burk et al. | |
| 2018/0093749 | A1 | 4/2018 | Wood et al. | |
| 2019/0265708 | A1 * | 8/2019 | Zottele | B63H 25/38 |

FOREIGN PATENT DOCUMENTS

| | | | |
|---|---|---|---|
| JP | 2959044 | B2 | 10/1999 |
| JP | 3232032 | B2 | 11/2001 |
| JP | 4409963 | B2 | 2/2010 |
| JP | 2016539861 | A | 12/2016 |

OTHER PUBLICATIONS

Extended European Search Report issued in Corresponding EP Application No. 22164074.1, dated Sep. 13, 2022.

* cited by examiner

66

| WHEEL ANGLE | MARINE DEVICE ANGLE |
|---|---|
| 5 | A |
| 10 | B |
| 20 | C |
| 50 | D |

68

| WHEEL ANGLE | MARINE DEVICE ANGLE |
|---|---|
| 5 | F(A) |
| 10 | F(B) |
| 20 | F(C) |
| 50 | F(D) |

72

| FORWARD LEVER DEMAND (%) | 0 | 10 | 20 | 30 | 40 | 50 | ... | 100 |
|---|---|---|---|---|---|---|---|---|
| REDUCED DEMAND | 0 | 5 | 10 | 12 | 14 | 16 | ... | 20 |

74

| REVERSE LEVER DEMAND (%) | 0 | 10 | 20 | 30 | 40 | 50 | ... | 100 |
|---|---|---|---|---|---|---|---|---|
| REDUCED DEMAND | 0 | 8 | 16 | 24 | 30 | 36 | ... | 50 |

FIG. 4

78

| F / R LEVER DEMAND (%) | 0 | 10 | 20 | 30 | 40 | 50 | ... | 100 |
|---|---|---|---|---|---|---|---|---|
| VESSEL SPEED (mph) | # | # | # | # | # | # | ... | # |

FIG. 5

SYSTEMS AND METHODS FOR STEERING A MARINE VESSEL

FIELD

The present disclosure relates to systems and methods for steering a marine vessel.

BACKGROUND

U.S. Pat. No. 6,138,596, which is incorporated herein by reference in its entirety, discloses a hydraulic damper for a steering system, such as that of a boat or watercraft. A manually movable steering mechanism, such as a steering wheel, is connected to a piston and cylinder combination in such a way that rotation of the steering wheel causes relative movement between the piston and cylinder. Hydraulic fluid is disposed within the cylinder in such a way that movement between the cylinder and piston requires the hydraulic fluid to move from one portion of the cylinder to another portion of the cylinder. This fluid movement is conducted through a conduit which can be external to the cylinder or internal to the cylinder and extending through the piston.

U.S. Pat. No. 6,273,771, which is incorporated herein by reference in its entirety, discloses a control system for a marine vessel incorporating a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Pat. No. 7,699,674, which is incorporated herein by reference in its entirety, discloses a steering mechanism that connects the shaft of an actuator with a piston rod of a hydraulic cylinder and provides a spool valve in which the spool valve housing is attached to the hydraulic cylinder and the shaft of the actuator extends through a cylindrical opening in a spool of the spool valve. The connector is connectable to a steering arm of a marine propulsion device and the spool valve housing is connectable to a transom of a marine vessel.

U.S. Pat. No. 8,046,122, which is incorporated herein by reference in its entirety, discloses a control system for a hydraulic steering cylinder utilizing a supply valve and a drain valve. The supply valve is configured to supply pressurized hydraulic fluid from a pump to either of two cavities defined by the position of a piston within the hydraulic cylinder. A drain valve is configured to control the flow of hydraulic fluid away from the cavities within the hydraulic cylinder. The supply valve and the drain valve are both proportional valves in a preferred embodiment of the present invention in order to allow accurate and controlled movement of a steering device in response to movement of a steering wheel of a marine vessel.

U.S. Pat. No. 8,113,892, which is incorporated herein by reference in its entirety, discloses a marine propulsion control system that receives manual input signals from a steering wheel or trim switches and provides the signals to first, second, and third controllers. The controllers cause first, second, and third actuators to move control devices. The actuators can be hydraulic steering actuators or trim plate actuators. Only one of the plurality of controllers requires connection directly to a sensor or switch that provides a position signal because the controllers transmit signals among themselves. These arrangements allow the various positions of the actuated components to vary from one device to the other as a result of calculated positions based on a single signal provided to one of the controllers.

U.S. Pat. No. 10,232,925, which is incorporated herein by reference in its entirety, discloses a method for steering a marine vessel powered by a marine engine and having a steerable marine drive that includes initiating a docking mode, and in response to initiation of the docking mode, reducing a steering ratio between input signals corresponding to steered positions of a steering wheel and output signals corresponding to desired steering angles of the marine drive, such that the steering ratio is less than the steering ratio would otherwise be were the vessel in a non-docking mode. Input signals are accepted from the steering wheel, and output signals are generated based on the input signals and the reduced steering ratio. The output signals are sent to a steering actuator coupled to the marine drive, which controls a position of the marine drive to the desired steering angles.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one embodiment, a method of controlling a steering system on a marine vessel includes, in response to receiving a user input to engage a quick steer mode where a reduced steering ratio is used, employing a reduced steering ratio to translate positions of a steering wheel to desired steering angles of a marine drive. A vessel speed of a marine vessel is determined and then compared to a threshold vessel speed. An output limit is determined to prevent the marine vessel from further exceeding the threshold vessel speed while the quick steer mode is engaged. The marine drive is automatically controlled based on the output limit and a steering actuator associated with the marine drive is controlled based on the reduced steering ratio.

In one embodiment, a steering system for a marine vessel includes a steerable marine drive rotatable about a steering axis to desired steering angles, a steering actuator configured to rotate the marine drive about the steering axis, a steering wheel manually rotatable by a user, and a wheel position sensor configured to sense a position of the steering wheel. The steering system further includes a user interface device configured to receive a user input to engage and disengage a quick steer mode and a control system configured to, in response to receiving a user input to engage a quick steer mode, employ a reduced steering ratio to translate positions of a steering wheel to desired steering angles of a marine drive. The control system is further configured to determine a vessel speed of the marine vessel and compare it to a threshold vessel speed. Upon the vessel speed exceeding the threshold vessel speed, the control system is configured to determine an output limit to prevent the marine vessel from further exceeding the threshold vessel speed while in the quick steer mode. The marine drive is automatically controlled based on the output limit and the steering actuator associated with the marine drive is controlled based on the reduced steering ratio.

Various other features, objects, and advantages of the invention will be made apparent from the following description taken together with the drawings.

BRIEF DESCRIPTION OF THE DRAWINGS

The present disclosure is described with reference to the following Figures.

Examples of systems and methods for steering a marine vessel are described with reference to the following Figures.

FIG. 4 illustrates an exemplary set of forward and reverse demand tables according to an embodiment of the present disclosure.

FIG. 5 illustrates and exemplary pseudo vessel speed table according to an embodiment of the present disclosure.

DETAILED DESCRIPTION

Figure 1:
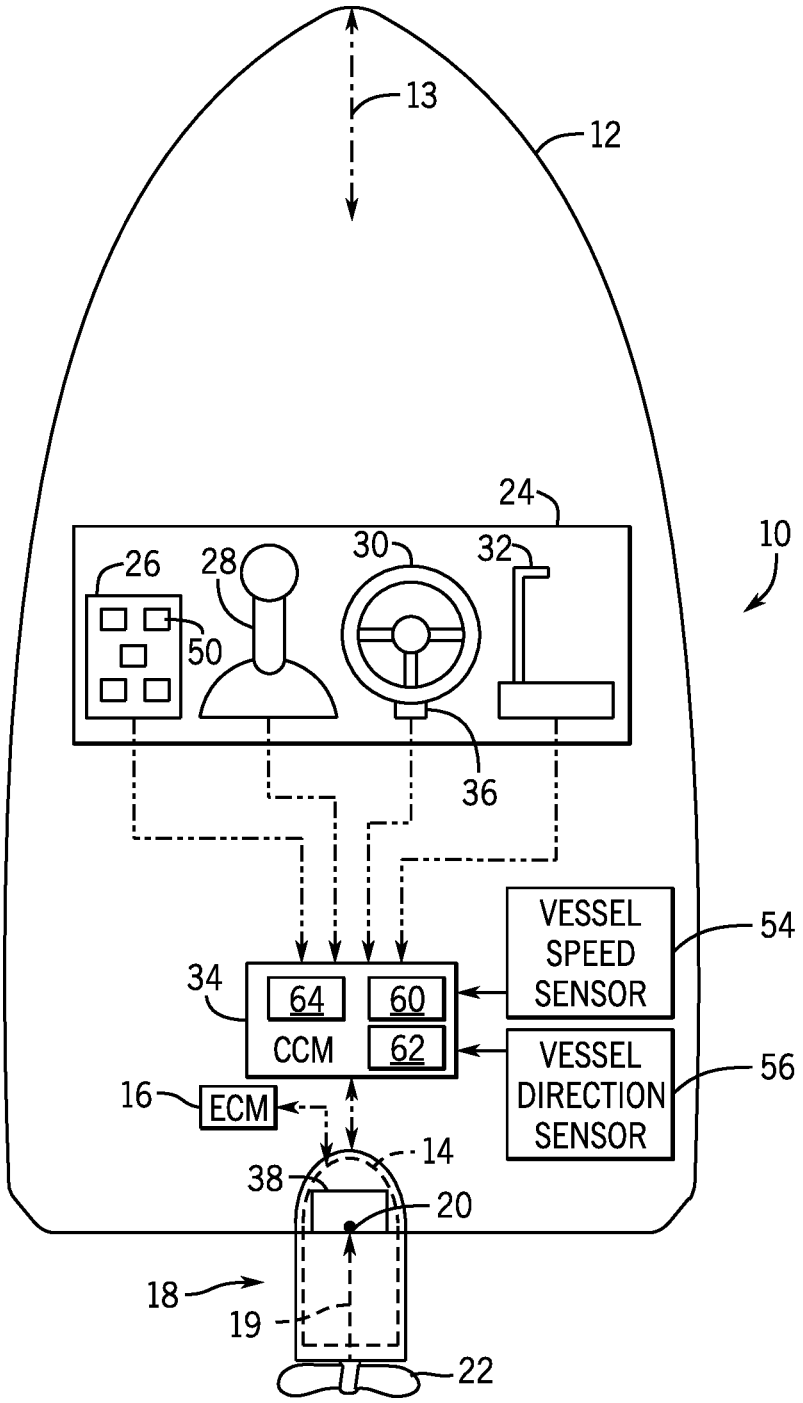
FIG. 1 is a schematic showing one example of a steering system for a marine vessel according to an embodiment of the present disclosure.

As described herein, the inventors engaged in development and testing of a "quick steer mode" for steering a marine vessel which reduces the steering ratio between steering wheel positions and desired steering angles of a marine drive so that the steering becomes more responsive and an operator can move the marine drive more quickly. This is helpful during docking, for example, where the operator is required to make significant drive angle changes very quickly to effectively steer the marine vessel at the slow docking speeds so as to avoid obstacles and accurately guide the marine vessel in close quarters. In the quick steer mode, the steering ratio is reduced significantly compared to the steering ratio utilized during normal vessel steering operation. In one example, the quick steer mode reduces the steering ratio by eight times and, for example, reduces the full steering range of four turns lock-to-lock during normal steering control to one-half turn lock-to-lock. This means that with only a quarter-turn of the steering wheel, the marine drive steers 100% of the drive angle range in that steering direction.

While very useful for steering the marine vessel at low speeds, this amount of steering responsiveness and sensitivity can become inappropriate when the vessel is traveling at high speeds. If the vessel is on plane with quick steer enabled, for example, the operator could more easily lose control of the vessel and end up with an undesirable steering response. Thus, the inventors have recognized a need to automatically limit vessel speed when the quick steer mode is enabled. However, the inventors have also recognized that simply capping the amount of demand that can be effectuated by a user, such as at a throttle lever, may be overly limiting and may hamper the effectiveness of the mode for docking. This is because in order to sufficiently limit user demand authority to keep the vessel speed slow enough in all situations where quick steer is enabled, the operator will not have sufficient demand to carry out maneuvers requiring quick thrust increases and their ability to effectively dock the vessel is hampered. For example, the user may need to effectuate high demand for a very short period, such as a thrust in the opposite direction of vessel travel to slow the marine vessel and/or to overcome high currents or winds.

In view of the foregoing challenges and problems in the relevant art recognized by the inventors, the disclosed system and method have been developed that effectuate an output limit only after the marine vessel reaches a threshold vessel speed. Thus, authority is granted to the operator when the vessel is moving at very low speeds, and user authority is only reduced when the marine vessel has reached a threshold vessel speed. For example, the threshold vessel speed may set sufficiently high such that it will not be reached during normal docking maneuvers and generally would not need to be exceeded in order to effectively dock a vessel. To provide just one example, the threshold vessel speed may be in the range of 5 to 10 miles per hour, and in some examples may be at or near 7 miles per hour or 8 miles per hour.

In certain embodiments, the system may further be configured to only impose an output limit restriction that restricts the user authority over the vessel speed in a direction of travel of the marine vessel. Thus, the operator will be prevented from further accelerating the marine vessel past the threshold vessel speed but will not be prevented from effectuating throttle demand in the opposite direction to quickly slow the marine vessel down. For instance, if the marine vessel is traveling forward at or above the threshold vessel speed, the operator will be limited as to the forward thrust that can be effectuated but will not be so limited as to the amount of reverse thrust that can be effectuated. Thus, the user is still enabled to quickly slow the marine vessel using reverse thrust.

In one embodiment, once the quick steer mode is engaged, such as upon receipt of a user input to engage the quick steer mode, a reduced steering ratio is employed to translate positions of the steering wheel into desired steering angles of the marine drive. While employing the reduced steering ratio, the system monitors vessel speed of the marine vessel, comparing it to a threshold vessel speed representing a maximum vessel speed for the quick steer mode, which may in certain embodiments include a forward threshold and a reverse threshold. If the vessel speed exceeds the threshold vessel speed, an output limit is determined and effectuated that prevents the marine vessel from further exceeding the threshold vessel speed while the quick steer mode is engaged. The marine drive is automatically controlled to produce thrust based on the output limit such that the threshold vessel speed is not exceeded while the steering actuator associated with the marine drive is controlled based on the reduced steering ratio in order to provide highly responsive steering. In one embodiment, the output limit is a reduced demand value based on the user demand input, such as a fractional reduction of the users' demand input. In other embodiments, the reduced demand may be determined based on the output limit, vessel speed, and/or direction of travel of the marine vessel compared to the users' demand input.

FIG. 1 illustrates a system 10 for steering a marine vessel 12, in this example powered by a marine drive 18, which in the depicted embodiment is an outboard motor. The marine drive 18 is coupled to the vessel 12 and rotatable about a vertical steering axis 19 to desired angles to affect the direction of travel of the vessel 12. However, in other examples, the powerhead 14 and steerable marine drive 18 need not be provided as a unit, such as the case in which the steerable marine drive 18 is a pod drive, stern drive, rudder, or any other steerable marine device capable of affecting the direction of the vessel 12. The marine drive 18 includes a powerhead 14, or power-supplying device, for the marine vessel, which may be an internal combustion engine, an electric motor, or a hybrid-electric system with an engine/motor combination. Additionally, although the marine drive 18 shown herein is provided with a propeller 22 for providing a thrust force to propel the vessel 12, other devices could be used, such as, but not limited to, an impeller or a jet drive.

The control system 10 shown herein also includes an operator console 24, which may be located at a helm of the vessel 12. The operator console 24 includes a keypad 26, a joystick 28, a steering wheel 30, and a throttle/shift lever 32. Any of the keypad 26, joystick 28, or steering wheel 30 can be used to provide steering commands to one or more controllers 34, 16 in the control system 10, which in turn communicate with the steering actuator 38 to rotate it about its steering axis 20, as will be described further hereinbelow. The joystick 28 and the throttle/shift lever 32 can also be used to provide commands to the marine drive 18 regarding gear selection and thrust magnitude. The control algorithms for performing such steering control, throttle control, and shift control are well known, and are described in some of the above-incorporated patents. In the present example, the steering wheel 30 has a sensor 36 that generates input signals corresponding to positions of the steering wheel 30. The sensor 36 may be, for example, a rotary encoder, as known to those having ordinary skill in the art. The sensor 36 sends the input signals, corresponding to the positions of the steering wheel 30, to the controller 34. The controller 34 then generates output signals based on the input signals, which output signals are sent to the steerable marine drive 18 and/or to the steering actuator 38 associated therewith. Further detail regarding the relationship between the input signals and output signals will be described hereinbelow.

The controller 34 may also receive input from the vessel speed sensor 54 and/or a vessel direction sensor 56. The vessel speed sensor 54 may be any device configured to sense vessel speed, such as a paddle wheel sensor or a pitot tube which are well known in the art. Alternatively or additionally, the vessel speed sensor 54 may include a GPS device configured to determine vessel speed based on GPS location over time. This may also provide a vessel travel direction. In other embodiments where a vessel speed sensor is not available, other methods of determining vessel speed may be used. For example, where the vessel speed sensor 54 suddenly fails or is not functioning properly, pseudo vessel speed may be utilized. As described in more detail below, the system 10 may store and employ a pseudo vessel speed table adapted over time for the particular marine vessel 12, where measured vessel speed is stored in association with corresponding user input demands, such as a corresponding throttle lever 32 position.

Alternatively or additionally, the vessel 12 may be equipped with a direction sensor 56, such as a compass, to indicate the vessel heading, or facing direction of the bow. This information may be utilized, in combination with the travel direction, to determine whether the vessel is moving forward or backward. In certain embodiments, the relative movement direction information may be utilized to more specifically implement the output limit only in the direction of travel of the marine vessel. The gear position of the marine drive at the time of the user input request and/or the position of the throttle lever (forward or reverse) may be utilized for determining whether the user is requesting forward or reverse thrust. For instance, if the marine vessel exceeds the threshold vessel speed traveling forward, the output limit will only be implemented to limit user authority over forward travel requests and will not impact reverse thrust commands. Thus, the user will retain full authority over reverse thrust (or at least the maximum reverse authority granted for reverse when the quick steer mode is engaged).

The control system includes one or more controllers 34, 16, which in the depicted embodiment comprise a command control module (CCM) 34 and an engine control module (ECM) 16. In other embodiments, different controller-types and numbers may be included. As will be understood by an ordinary skilled person in view of the present disclosure, portions of the method disclosed hereinbelow can be carried out by a single controller or by several separate controllers communicatively connected and acting in cooperation. If more than one controller is provided, each can control operation of a specific device or sub-system on the marine vessel 12. Each controller 34, 16 is programmable and includes a processing system (e.g. processor 60) and a storage system (e.g. memory 62). Each controller 34, 16 can be located anywhere in the system 10 and/or located remote from the system 10 and can communicate with various components of the vessel 12 via a peripheral interface and wired and/or wireless links, as will be explained further hereinbelow. For example, the CCM 34 may be located at or near a helm of the marine vessel and the ECM 16 may be located at or near the steerable marine drive 18.

In some examples, the controller 34 may include a computing system that includes a processing system, storage system, software, and input/output (I/O) interface 64 for communicating with peripheral devices. The systems may be implemented in hardware and/or software that carries out a programmed set of instructions. For example, the processing system loads and executes software from the storage system, such as software programmed with a method for steering a vessel, which directs the processing system to operate as described hereinbelow in further detail. The computing system may include one or more processors, which may be communicatively connected. The processing system can comprise a microprocessor, including a control unit and a processing unit, and other circuitry, such as semiconductor hardware logic, that retrieves and executes software from the storage system. The processing system can be implemented within a single processing device but can also be distributed across multiple processing devices or sub-systems that cooperate according to existing program instructions. The processing system can include one or many software modules comprising sets of computer executable instructions for carrying out various functions as described herein.

The storage system can comprise any storage media readable by the processing system and capable of storing software. The storage system can include volatile and non-volatile, removable and non-removable media implemented in any method or technology for storage of information, such as computer-readable instructions, data structures, software modules, or other data. The storage system can be implemented as a single storage device or across multiple storage devices or sub-systems. The storage system can include additional elements, such as a memory controller capable of communicating with the processing system.

The controller 34 communicates with one or more components of the control system 10 via the I/O interface 64 and a communication link, which can be a wired or wireless link, and is shown schematically herein by dashed lines. The controller 34 is capable of monitoring and controlling one or more operational characteristics of the control system 10 and its various subsystems by sending and receiving control signals via the communication link. In one example, the communication link is a controller area network (CAN) bus, but other types of links could be used.

The controller 34 and various associated software modules functionally convert input signals, such as but not limited to vessel control signals, to output signals, such as but not limited to actuator control signals, according to the computer executable instructions. Each of the input signals can be split into more than one branch, depending on how many functions are to be carried out and/or how many actuators are to be controlled with each of the input signals. The input signals may be fed to several software modules within the controller 34. The exact signals input into the software modules can be taken directly from the corresponding control input device or sensor, or could be pre-processed in some way, for example by scaling through an amplifier or by converting to or from a digital signal or an analog signal using a digital-to-analog or an analog-to-digital converter. It should be appreciated that more than one input signal can be combined to provide an output signal, in which case the individual input signals may be input to the same software modules or may each be provided to an individual software module. Note that in the event that more than one signal is used to generate an output signal, a post-processing module, such as a summer, a selector, or an averaging module is used to combine the input signals into an output signal.

A steering actuator 38 is in signal communication with the controller 34 via the communication link. The steering actuator 38 may be a hydraulic piston-cylinder combination, a rack and pinion device, or any other steering actuator for a steerable marine drive known to those having ordinary skill in the art. In the example shown, the steering system is therefore a steer-by-wire system, in which no mechanical linkages are provided between the operator console 24 and the steering actuator 38. Rather, the steering actuator moves the marine drive 18 to desired steering angles in response to the output signals from the controller 34. The desired steering angles can be defined as an angle of the longitudinal centerline 19 of the steerable marine drive 18 with respect to an imaginary longitudinal centerline 13 of the vessel 12 or any line running perpendicular to the transom of the vessel, as the marine drive 18 rotates about its steering axis 20 with respect to the vessel 12. Of course, other ways of defining the steering angle of the marine drive 18 are contemplated as being within the scope of the present disclosure.

Figures 2, 3A, 3B:
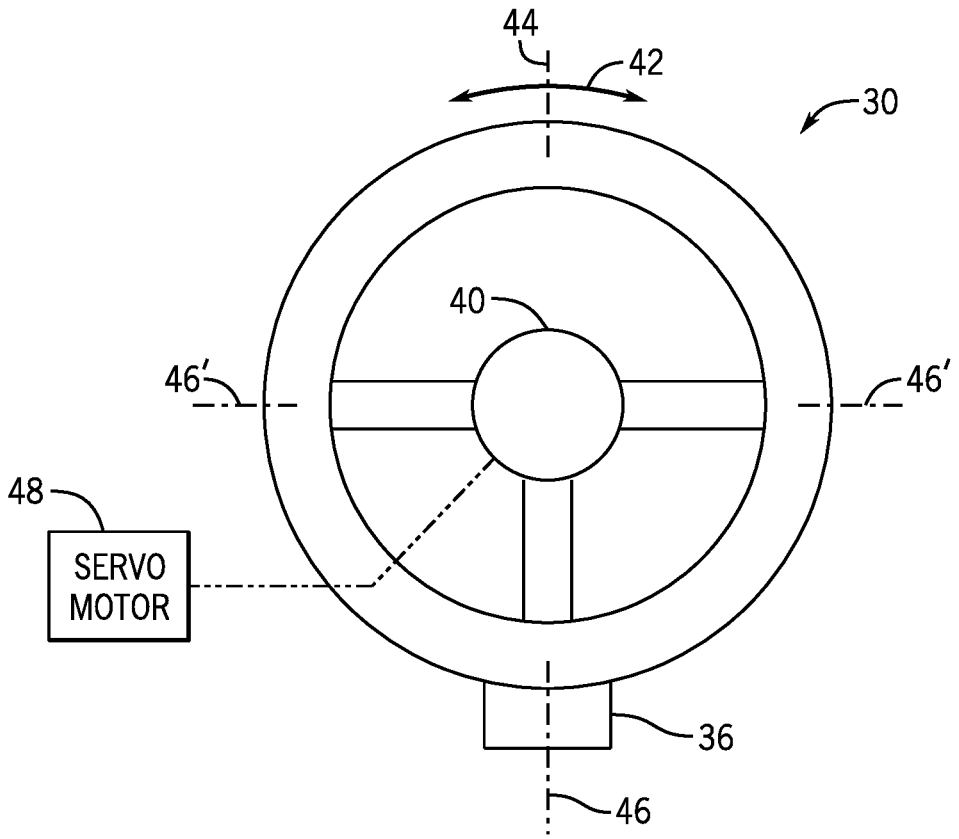
FIG. 2 illustrates one example of a steering wheel for the marine vessel.
FIGS. 3A and 3B illustrate examples of steering angle maps according to an embodiment of the present disclosure.

FIG. 2 illustrates a top view of the steering wheel 30. As mentioned above, the steering wheel 30 can be provided with a sensor 36, such as an encoder or other type of transducer which generates input signals (to be sent to the controller 34) corresponding to steered positions of the steering wheel 30. The steering wheel 30 is shown in a zero degree position, or centered position, in which no rotation of the marine drive 18 is requested and the vessel 12 is therefore steered straight ahead. The steering wheel 30 can be rotated about its hub 40 as generally shown by the arrow 42. In one embodiment, a center line 44 is depicted as a dashed line and is directed straight ahead (upward with respect to the plane of the drawing), which corresponds to a request for movement of the vessel 12 straight ahead. Rotation of the steering wheel 30 as shown by the arrow 42 may occur in a clockwise or counterclockwise manner, as is conventionally known. In the embodiment shown, when the steering wheel 30 is rotated counterclockwise by a given number of turns until the center line 44 meets an end-stop/lock line 46, a left stop condition is met and the steering wheel 30 will no longer rotate in the counterclockwise direction. Similarly, rotation of the steering wheel 30 in a clockwise direction by a given number of turns until the center line 44 meets the end-stop/lock line 46 corresponds to a right stop in which the steering wheel 30 may no longer be rotated in the clockwise direction. The number of turns in the counterclockwise direction from the neutral, centered position shown in FIG. 2 to the position where the steering wheel 30 is stopped, plus the number of turns in the clockwise direction from the neutral, centered position to where the steering wheel 30 is stopped, defines a number of turns from lock-to-lock of the steering wheel 30.

Because the control system 10 is a steer-by-wire system, it is desirable to provide physical feedback force required from the operator to turn the steering wheel 30 over what would otherwise be required were no counteracting force provided. Such power steering systems are known to those having ordinary skill in the art, and in the present disclosure include a servo motor 48 coupled to the hub 40 of the steering wheel 30 to provide resistance to rotation thereof. The servo motor 48 provides a resistance to turning about the hub 40 that is able to be overcome by the operator before the stop position is reached, in order that the operator feels as though he is turning against the force of water acting on the marine drive 18; and the servo motor 48 provides a resistance that is not able to be overcome by the operator when the stop/lock line 46 is reached, thereby preventing further turning of the steering wheel 30. In other examples, the steering wheel 30 can be provided with a device containing magnetorheological fluid, which, when a magnetic field is applied, provides variable resistance to turning of the hub 40. In other examples, disc brake-type clutches can be used to stop the steering wheel 30 from rotating when the stop/lock line 46 is reached.

As is known, the sensor 36 in the steering wheel 30 may include an encoder that produces an electrical signal for input to the controller 34. FIG. 3A shows one example of a steering angle input-output map 66, which relates input signals from the steering wheel 30 to output signals to the steering actuator 38. Such input signals are shown in the left-hand column of FIG. 3A as "wheel angle," and therefore represent a steered angle of the steering wheel 30. Using a map stored in its memory 62, the controller 34 correlates the input signals to output signals corresponding to desired steering angles of the marine drive 18. The output signals are shown in the right column of the table in FIG. 3A as "marine drive angle." The tabular format of the input-output map 66 depicted herein is merely exemplary; in other examples, the controller 34 relates the input signals to the output signals by using a graph, map, look-up table, equation, or other input-output algorithm.

These output signals are sent from the controller 34 to the steerable marine drive 18, which interprets the signals and actuates the steering actuator 38 to provide the desired steering angles. Note that for values between 5 and 10 degrees of actuation of the steering wheel 30, or between 10 and 20 degrees, etc., a prescribed form of interpolation (e.g., linear interpolation) can be used to determine the corresponding output. Note that the input-output map 66 can include much higher values and can also include negative values for distinguishing between clockwise and counterclockwise rotation of the steering wheel 30 and the marine drive 18. For example, the input-output map 66 should include values up to the stop/lock line 46 of the steering wheel 30, which is correlated to a maximum steering angle of the marine drive 18.

The steering wheel positions and desired drive angles shown in the table of FIG. 3A inherently have a steering ratio (e.g., the number of turns of the steering wheel 30 to the rotational angle of the marine drive 18). This steering ratio may be linear, such that the ratio 5:A is the same as the ratio 10:B, is the same as the ratio 20:C, is the same as the ratio 50:D, etc. In other examples, the steering ratio may vary according to different functions, may incorporate cut-off limits, and/or may depend on a measured value such as vessel speed, as is known to those having ordinary skill in the art. In one example, the steering angle input-output map 66 shown in the table of FIG. 3A is used in a normal, non-quick steer mode of the control system 10, wherein the alternative quick steer mode will be described below.

An operator may wish to initiate a quick steer mode when in close quarters and/or when docking the vessel 12 near a dock, pier, or other object. While undertaking such a task, it is often advantageous for the operator to be able to steer the steering wheel 30 from lock to lock as fast as possible. For example, maneuvers around a dock often call for hard-oversteering in one direction in forward gear, followed by hard-oversteering in the opposite direction in reverse gear. This sequence is often repeated numerous times in quick succession to move the vessel 12 in a desired manner. By way of example and referring to FIG. 2, if the system is set up with a nominal 2.75 turns from a centered, neutral position (with center line 44 pointing straight ahead) to a stop/lock position (with center line 44 aligned with stop/lock line 46) each forward or reverse gearshift is preceded by 5.5 turns of the steering wheel 30. To assist the vessel operator while steering from lock to lock multiple times, hydraulic steering has been provided to decrease the required steering forces. Additionally, the use of a steering wheel knob is common, which allows the operator to grip the knob and turn the steering wheel 30 as fast as possible from lock to lock. This single-handed motion allows the operator to keep his or her other hand on the throttle/shift lever 32, which aids in increasing the possible speed of the cycle from lock to lock.

Applicant has developed a system 10 in which, in response to initiation of the quick steer mode, the controller 34 reduces a steering ratio between the input signals and the output signals, such that the steering ratio is less than the normal steering ratio would otherwise be when not in the quick steer mode. The controller 34 thereafter generates the output signals based on the input signals and the reduced steering ratio. Thus, the input from the steering wheel 30 can be decreased from requiring multiple turns between center line 44 being in the neutral, centered position to center line 44 being aligned with stop/lock line 46, to requiring only one turn (or a fraction of a turn) between center line 44 being in the neutral, centered position to center line 44 being aligned with stop/lock line 46, in order to command the marine drive 18 to its full steering angle range. As one example, the steering wheel 30 need only be turned plus or minus ninety degrees (plus or minus one quarter turn) from having center line 44 in the neutral, centered position in order to command such a full steering angle range of the marine drive 18 (e.g., plus or minus thirty degrees). See positions 46' in FIG. 2. Although the present system and method are particularly helpful with single-propulsion device systems, the system and method disclosed herein could also be used with multiple-propulsion device systems. By requiring an operator to turn the steering wheel 30 by fewer degrees than usual to obtain full actuation range of the marine drive 18, the speed in which docking maneuvers can be accomplished is greatly increased, and the effort involved is minimized. Shifting of the powerhead 14 can also take place at a quicker pace, aiding in more precise movements during close quarter maneuvering.

For example, with brief reference to FIG. 1, the quick steer mode selection button 50, which may likewise be a switch, may be provided on the keypad 26 at the operator console 24. Note that the keypad 26 may alternatively be a touchscreen, and the quick steer mode selection button 50 may alternatively be an icon on the touch screen. In other examples, the quick steer mode selection button 50 may be provided other than at the keypad 26, such as near the steering wheel 30. In still other examples, the quick steer mode selection switch may be actuated in response to a voice command, cursor selection of a computer screen icon, or any other mode of inputting commands to a controller 34 known to those having ordinary skill in the art. The method may include initiating the quick steer mode in response to selection of a quick steer mode option by an operator of the vessel 12, for example by actuation of the quick steer mode button 50 or button.

A reduced steering ratio between the steering wheel 30 positions and the output signals corresponding to desired steering angles of the marine drive 18 is then employed to control vessel steering. The algorithm at 514 may further comprise decreasing a number of lock-to-lock turns of the steering wheel 30 in response to initiation of the quick steer mode, such that the number of lock-to-lock turns is less than the number of lock-to-lock turns would otherwise be were the vessel 12 in the normal steering mode. This provides feedback to the operator as the steering wheel 30 is turned that indicates the steerable marine drive 18 has been rotated to its steering angle limits. In other words, the controller 34 dynamically changes the end stops of the steering wheel 30 once the system 10 is in the quick steer mode. For example, with reference to FIG. 2, the controller may define the end stops at stop/lock lines 46' on either side of the center line 44. The controller 34 can do so by way of a steering map or table, wherein as the steering wheel 30 approaches a newly-defined end stop at stop/lock lines 46', the controller 34 brakes the steering wheel 30. For example, the method may include braking the steering wheel 30 once the steering wheel 30 has been rotated from having the center line 44 in the neutral, centered position by half the number of newly-defined lock-to-lock turns. The controller 34 can receive a signal from the sensor 36 as to the position of the steering wheel 30, and when that position reaches the newly-defined stop/lock line 46', the controller 34 instructs the servo motor 48 to prevent further turning of the steering wheel 30. In another example, a dedicated steering controller may be provided and configured to control the end-stop braking of the steering wheel 30 based on the sensed positions.

The controller 34 may accomplish reduction of the steering ratio in various ways. The method may include multiplying the output signals from a steering angle map by a predetermined multiplier in response to initiation of the quick steer mode prior to sending the output signals to the steering actuator 38. For example, if a memory 62 of the controller 34 contains a steering angle map that correlates the output signals to the input signals, as shown in FIG. 3A, the controller 34 may simply multiply the output signals determined from the map by a multiplier, such as, for example, eight or ten, prior to sending the output signals to the steering actuator 38. Alternatively, a memory 62 of the controller 34 may contain a reduced steering angle map utilized for quick steer mode that correlates the steering wheel positions to the desired drive angle, and the controller 34 may select a steering angle map incorporating the reduced steering ratio in response to initiation of the quick steer mode. Referring briefly to FIG. 3B, one example of such a steering angle input-output map 68 incorporating the reduced steering ratio is provided. Similar to the steering angle input-output map 66 for use in the non-quick steer mode provided in FIG. 3A providing a normal steering ratio (or for use in the quick steer mode with application of a multiplier) the steering angle input-output map 68 shown in FIG. 3B includes a table having a left had column corresponding to the input signals—i.e., measured wheel position, or wheel angle. However, the righthand column of the table in FIG. 3B has been modified, such that the values of the output signals—desired drive angle—are functions of the output signals in the input-output map 66 used for the non-quick steer mode. For example, the functions could incorporate a simple multiplier, or could define a linear relationship, an exponential relationship, or any other type of relationship desired by the calibrator.

The functions are programmed such that the steering angle ratios in the map 68 of FIG. 3B are less than the steering angle ratios in the map 66 of FIG. 3A. In other words, the ratio of 5:F(A) is less than the ratio of 5:A, the ratio of 10:F(B) is less than the ratio of 10:B, and so forth. Although simple input-output maps 66, 68 are shown in FIGS. 3A and 3B, note that either or both of the maps could instead be charts or graphs, incorporating for example gull-wing or bell-shaped relationships between the input signals and the output signals.

By way of remapping of the steering inputs and outputs, steering actuation from lock-to-lock can be accomplished in less time, with less motion and effort required on the part of the vessel operator. The steering can easily be managed by the operator using only one hand, while his or her other hand remains on the throttle/shift lever 32 for easier throttle and shift control.

The output limit is then effectuated, as necessary, to prevent the marine vessel from operating at an inappropriately high speed while the quick steer mode is engaged. In exemplary embodiments, a predefined demand limit may be imposed throughout the entirety of quick steer operation, such as to limit the demand to 50 percent or 75 percent of the normal maximum available demand limit. Thus, during normal operation of the quick steer mode—i.e. where the marine vessel remains below the threshold vessel speed—less than the full thrust capability of the marine drive may be available. In such situations, user authority at low and moderate demand levels will not be limited, so long as the user demand does not exceed the implemented limit. This is because full throttle and full thrust capabilities, such as utilized during high speed vessel operation, are typically not necessary during docking.

However, sufficient authority may still be granted that, especially if applied for an extended period of time, could enable the marine vessel to travel at relatively high speeds and/or get on plane. This is because, as described above, the user may need sufficient thrust capabilities to quickly slow the marine vessel and/or to control the marine vessel against wind and currents. Therefore, vessel speed of the marine vessel is continuously monitored and, if the threshold vessel speed is exceeded, an output limit is implemented to restrict user authority over output of the marine drive, and thus over vessel speed, to prevent the marine vessel from further exceeding the threshold vessel speed while in the quick steer mode. For example, the output limit may be determined utilizing tables to calculate a reduced demand value based on a user demand input. In another exemplary embodiment, the output limit may be determined via a proportional integral derivative (PID) controller configured to determine the output limit based on vessel speed and the threshold vessel speed.

FIG. 4 depicts one embodiment of tables that may be utilized to determine a reduced demand value once the threshold vessel speed has been reached. In the depicted example, separate reduced demand tables are provided, including a forward reduced demand table 72 and a reverse reduced demand table 74. The forward reduced demand table 72 is utilized to determine the output limit when the direction of travel of the marine vessel is forward and the user demand input, such as at the throttle lever 32, demands forward thrust. Similarly, the reverse demand table 74 is utilized to determine the output limit when the direction of travel of the marine vessel 12 is backward and the user demand input requests a reverse demand, or reverse thrust.

Each of the reduced demand tables 72 and 74 provides a reduced demand value corresponding to a user demand input, which in the depicted example is a lever demand based on lever position. The depicted example presents lever demand as a percentage between 0%, representing neutral or idle, and 100% associated with full throttle forward or reverse thrust requests. For example, if the throttle lever 32 is moved 20% of the full movement range in the forward direction, then the user input demand is 20% forward lever demand. In an instance where the marine vessel exceeds the vessel speed limit and the user demand input is 20% lever demand, a reduced demand of 10% will be utilized. Thus, when the vessel exceeds the threshold speed, half of the thrust requested by the user will be effectuated. In certain examples, the user authority limit becomes more restrictive for higher demand values, such that as the user requests more thrust comparatively less thrust is effectuated. In the depicted example, as the lever demand increases, a progressively smaller percentage of the requested demand is provided such that at 100% lever demand only 20% is provided as the reduced demand instruction and the marine drive 18 is controlled accordingly.

In certain embodiments, a separate reverse reduced demand table 74 may be provided that yields different reduced demand behavior from the forward reduced demand table 72. In certain embodiments, comparatively more thrust may be required for effectuating reverse commands during docking than for effectuating forward commands. Reverse thrust is often utilized by operators during docking to slow the marine vessel quickly and/or avoid hitting objects. Further, certain propellers are less efficient at effectuating reverse thrust versus forward thrust, some being significantly less efficient. For instance, some propellers are 50 percent less effective at displacing water when spinning in a reverse rotational direction than in the forward rotational direction. For these reasons, in some embodiments it is beneficial to implement lesser authority restrictions over user demand and/or output by the marine drive 18 in the reverse direction than in the forward direction. In the example at FIG. 4, the reverse reduced demand table 74 provides lesser output limit restrictions (i.e., lesser demand reductions compared to the demand reductions implemented for forward demand). Where the reverse lever demand is at 10%, the reduced demand value is, for example, 8%. This is compared to the reduced demand value in forward, which is 5% when the forward lever demand is at 10%. All of the reverse reduced demand values may likewise be comparatively larger in reverse than for forward thrust, as exemplified in FIG. 4.

The output limit may be calculated in other ways than using demand tables, such as by utilizing a PID controller to determine the output limit based on the vessel speed and the threshold vessel speed. In such an embodiment, the PID may be configured to receive the vessel speed measurements (or pseudo-vessel speed as described below) and to generate an output term based on the difference between the vessel speed and the calibrated threshold vessel speed. Thus, the output limit is the correction based on the error determined as the difference between the threshold vessel speed and the actual vessel speed, wherein the output limit is configured to keep the vessel speed at or below the threshold. The output limit then gets subtracted from or otherwise reduces the users demand input when the vessel speed exceeds the threshold, thereby generating the reduced demand instruction. When the vessel speed is at or below the threshold vessel speed, the output limit will be zero and thus the demand instruction will reflect the user's demand input.

In other embodiments, the output limit restriction may be implemented using a different value than user demand. For example, the output limit restriction may be an RPM limit that limits the rotational speed of the marine drive (e.g., engine RPM or motor rotational speed), such as a reduced RPM limit based on vessel speed and/or based on user demand input. Alternatively or additionally, the output limit may include a thrust output limit that limits a thrust output of a marine drive 18, which again could be based on measured vessel speed and/or based on user demand input. In still other embodiments, the output limit may be throttle valve position, or may be any other value that corresponds with the amount of thrust force exerted by the marine drive 18 on the vessel. For instance, tables associating an RPM limit and/or a thrust output limit with lever demand could be utilized to implement an output limit that prevents the marine vessel from further exceeding the threshold vessel speed while in the quick steer mode.

In certain embodiments where vessel speed measurements are not available, such as due to sudden failure of unavailability of a GPS device or other speed measurement device, pseudo-vessel speed may be determined based on one or more values relating to user demand inputs. For example, the system 10 may store and adapt a pseudo-vessel speed table providing vessel speed values based on user demand input values. FIG. 5 exemplifies one embodiment of a pseudo-vessel speed table for a particular marine vessel which includes stored vessel speeds measured at pre-determined lever demand values. These stored vessel speeds are acquired over time and are based on actual vessel speed measurements at the respective lever demand values, and thus provide accurate vessel speed estimates based on lever demand. This adapted pseudo-boat speed table can then be utilized in place of actual vessel speed measurements in instances where the vessel speed sensor fails and/or actual vessel speed measurements become unavailable. A determination of whether the threshold vessel speed is exceeded can then be determined based on pseudo-vessel speed and an output limit implemented accordingly as described above.

Figure 6A:
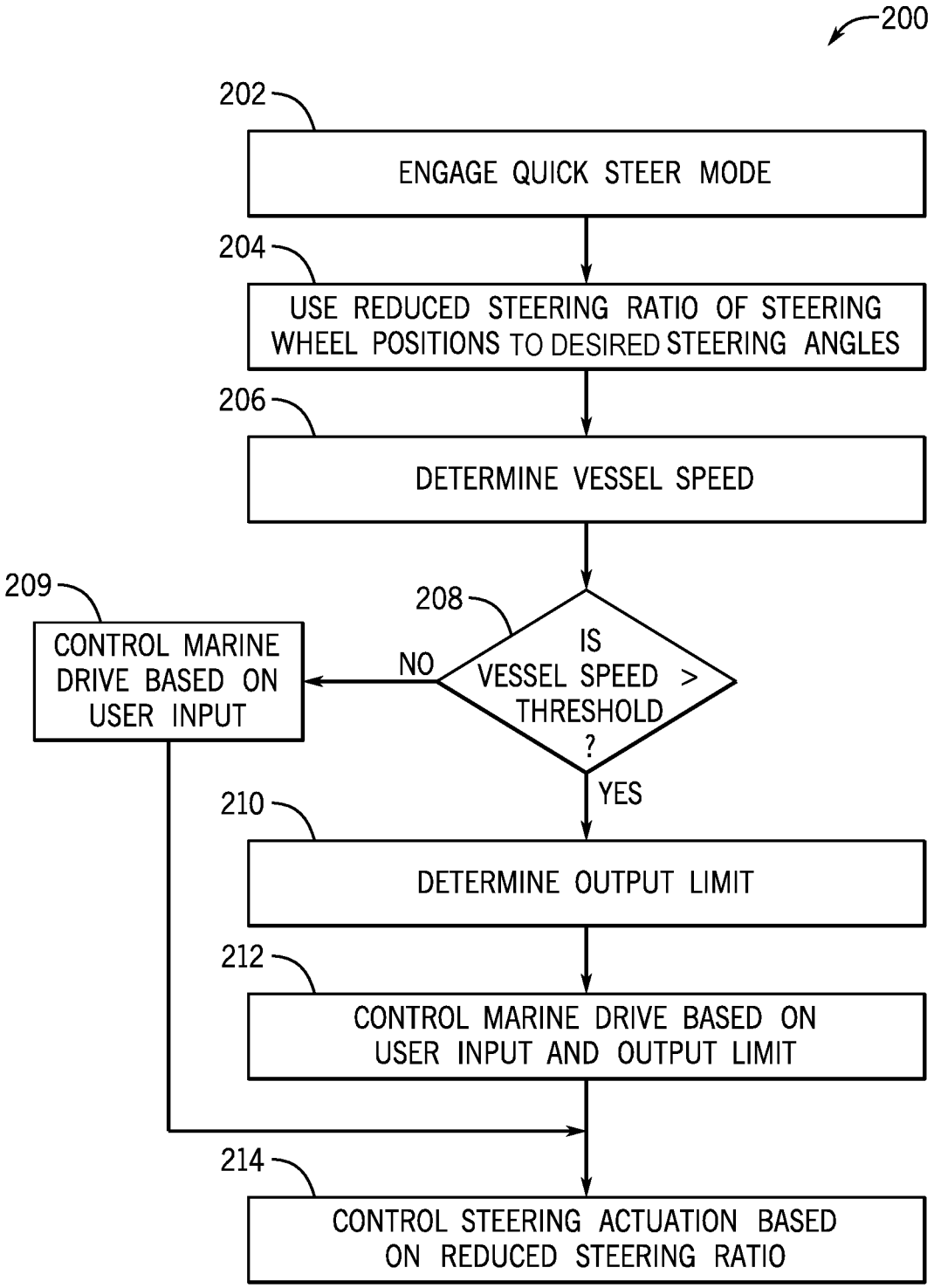
FIGS. 6A and 6B are flow charts exemplifying embodiments of a method for controlling a steering system on a marine vessel according to the present disclosure.
Figure 6B:
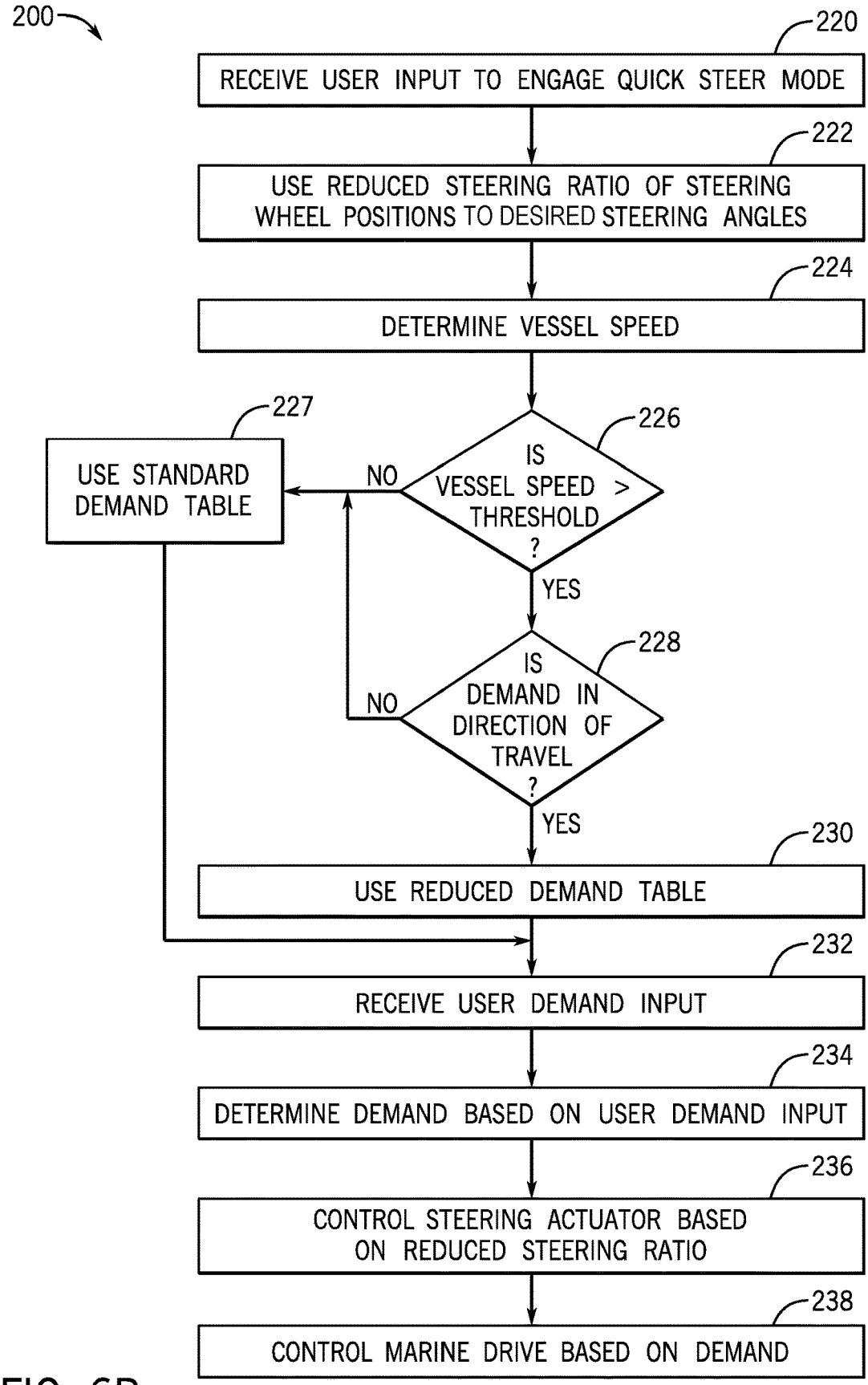
Figure 7:
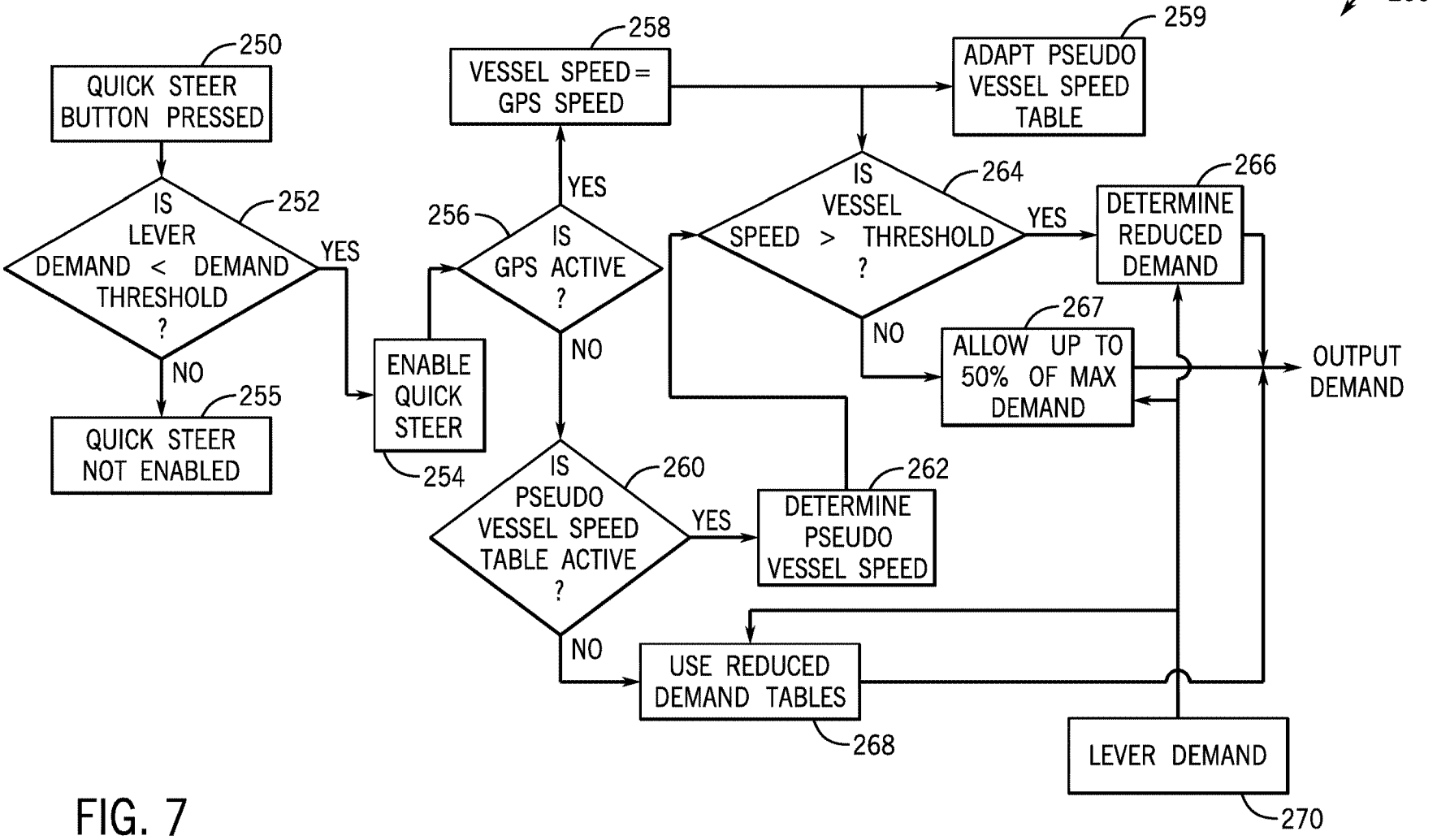
FIG. 7 illustrates another example of a method for controlling a steering system on a marine vessel according to the present disclosure.

FIGS. 6A-6B and 7 depict various embodiments of methods 200 of controlling a steering system on a marine vessel. Once quick steer mode is engaged at step 202, such as in response to user input, the reduced steering ratio is utilized to convert steering wheel positions to desired steering angles of the marine drive at step 204. Vessel speed is determined at step 206, such as utilizing the vessel speed sensor, examples of which are described above. Alternatively, pseudo-vessel speed may be utilized, which is also described above. So long as the vessel speed remains below the threshold vessel speed, then the marine drive is controlled at step 209 based on user input. In certain embodiments, an upper bound limit may be set for effectuated demand and/or thrust output while in the quick steer mode. To provide just one example, in certain embodiments, a maximum of 50% of available thrust or a maximum of 50% demand may be available while in the quick steer mode. Thus, the operator's demand may be effectuated so long as it remains below the upper bound, or limit, set for the quick steer mode so long as the vessel speed remains below the vessel speed threshold.

However, once the vessel speed exceeds the threshold vessel speed set for effective operation of quick steer, then an output limit is effectuated. The output limit is determined at step 210. For example, the forward and reverse reduced demand tables 72 and 74 may be utilized, as is described above. Alternatively, a PID may be implemented to calculate the output limit based on the vessel speed, where the output limit is a correction term based on the difference between the vessel speed and the threshold vessel speed and is applied to keep the vessel speed at or below the threshold. The marine drive is then controlled at step 212 based on the user demand input and the output limit. The steering actuator is controlled at step 214 based on the reduced steering ratio. In certain embodiments, this operation in the quick steer mode, including implementation of the output limit when appropriate, continues until a user provides input to disengage the quick steer mode, such as by operating a quick steer button as described above.

FIG. 6B depicts another embodiment of a method 200 of controlling the steering system on a marine vessel in accordance with the present disclosure. In the depicted example, user input is received at step 220 to engage the quick steer mode. The reduced steering ratio is utilized at step 222 to translate steering wheel positions to desired steering angles, where increased steering reactivity is provided as described herein. Vessel speed is determined at step 224, which again may be a measured vessel speed or a pseudo-vessel speed. So long as the vessel speed remains below the vessel speed threshold at step 226, the standard demand table is utilized for converting user demand to thrust output, which is selected at step 227. In certain embodiments, as described above, an upper demand limit or thrust output threshold may be implemented while in the quick steer mode, which may be implemented on top of the standard demand table, for example.

If the vessel speed exceeds the threshold vessel speed at step 226, then further logic is executed to determine whether the user demand input is in the same direction as the current direction of travel of the marine vessel. It is determined at step 228 that the user demand is at the opposite direction than the current direction of travel (e.g., the marine vessel is traveling forward and the user demands reverse thrust), then the standard demand table is still selected at step 228. However, if the user demand input is in the same direction as the current direction of travel of the marine vessel, then the reduced demand table is selected at step 230. For example, the appropriate one of the forward or reverse reduced demand tables 72 and 74 may be selected based on the user demand input. The selected one of the reduced demand table or the standard demand table are then utilized at step 232-238 to control the marine drive. User demand input received at step 232 is then applied to the selected demand table to determine a demand at step 232 that gets conveyed to the marine drive 18. The steering actuator is controlled at step 236 based on the reduced steering ratio and the marine drive is controlled at step 238 based on the demand value, such as the reduced demand value if the vessel speed has exceeded the threshold vessel speed.

FIG. 7 is another flow chart depicting another embodiment of a method 200 for controlling a steering system on a marine vessel. User input is received at 250 in the form of an operator pressing a quick steer button, such as the quick steer selection button 50 described above. Step 252 is then executed to determine whether the lever demand value is less than a demand threshold. If the lever demand is too high and thus not below the threshold, then the quick steer mode does not get enabled, as shown at step 255. To provide one example, the demand threshold may be a low demand threshold associated with idle, such as at or around a 2% demand threshold. In other embodiments, the demand threshold may be greater than or less than 2%, but may still be a relatively low demand associated with low-speed vessel travel. This prevents activation of quick steer when the marine vessel is traveling at high speeds, which could create an undesirable steering response. In certain embodiments, an error may be generated if the quick steer mode is not enabled at step 255, which may be an audio and/or visual error presented via the user interface devices at the operator console 24. So long as the lever demand is below the demand threshold, then the quick steer mode is enabled at step 254. Step 256 is executed to determine where the GPS system on the marine vessel is active, which in this embodiment is the mode by which vessel speed is determined. So long as the GPS is active, then the vessel speed is determined at step 258 as the GPS speed according to standard practices. That vessel speed may be saved in the pseudo-vessel speed table at step 259 in association with the current user input demand, thus providing an adapted pseudo-vessel speed table adapted based on behavior of the marine vessel 12.

If the GPS is not determined to be active at step 256, then step 260 is effectuated to determine whether the pseudo-vessel speed table is active. For example, the pseudo-vessel speed table may be active once a vessel speed is stored for all or at least a predefined range of lever demand values. If the pseudo-vessel speed table is active, then it is utilized at step 262 to determine vessel speed. So long as a speed can be determined, such as by measured vessel speed or pseudo-vessel speed, then the vessel speed-based control algorithms described above can be utilized. So long as the vessel speed remains below the threshold vessel speed at step 264, then the marine drive is controlled based on the user input, allowing up to 50% of the maximum demand value and/or up to 50% of the maximum thrust output that the marine drive is capable of, as represented at step 267. Once the vessel speed exceeds the threshold at step 264, then the output limit is implemented at step 266, such as a reduced demand. For example, the standard demand table and reduced demand tables described above with respect to the method shown in FIG. 6B may be utilized at step 266 and 267 based on the lever demand input 270 to generate the output demand. In another embodiment, a PID may be implemented to calculate the output limit based on the vessel speed, where the output limit is a correction term based on the difference between the vessel speed and the threshold vessel speed and is applied to keep the vessel speed at or below the threshold.

If neither measured vessel speed nor pseudo-vessel speed are available, then the reduced demand tables may be utilized at step 268 to determine the output demand based on lever demand input 270. For example, the reduced demand tables, such as the forward and reverse reduced demand tables 72 and 74 exemplified in FIG. 4, may be utilized to determine a reduced demand regardless of vessel speed. Thereby, the quick steer mode can be operated without concern of excessive vessel speed. However, the reduced demand tables, used alone without any vessel speed threshold, may excessively limit the user's authority over thrust output and the user may find that such restrictive output limits hamper the ability to control the marine vessel effectively at low speeds, such as for docking purposes.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A method of controlling a steering system on a marine vessel, the method comprising:

in response to receiving a user input to engage a quick steer mode, employing a reduced steering ratio to translate positions of a steering wheel to desired steering angles of a marine drive;

determining a vessel speed of the marine vessel;

comparing the vessel speed to a threshold vessel speed;

upon determining that the vessel speed exceeds the threshold vessel speed, determining output limit to prevent the marine vessel from further exceeding the threshold vessel speed while the quick steer mode is engaged; and controlling the marine drive based on the output limit and controlling a steering actuator associated with the marine drive based on the reduced steering ratio and the positions of the steering wheel.

2. The method of claim 1, wherein the output limit prevents effectuating a user commanded vessel speed increase only in a direction of travel of the marine vessel.

3. The method of claim 1, wherein the output limit includes a reduced demand to the marine drive in a direction of travel of the marine vessel.

4. The method of claim 3, wherein the reduced demand is a percentage of a user demand input.

5. The method of claim 3, further comprising determining the reduced demand based on at least one of a user demand input, a vessel speed, gear position of the marine drive, and a direction of travel of the marine vessel.

6. The method of claim 5, wherein determining the reduced demand includes utilizing a forward reduced demand table when the direction of travel is forward and the user demand input requests a forward demand, and utilizing a reverse reduced demand table when the direction of travel is backward and the user demand input requests a reverse demand, and wherein the forward reduced demand table and the reverse reduced demand table each provide reduced demand values based on user demand input values.

7. The method of claim 6, wherein the reduced demand values in the reverse reduced demand table are greater than the reduced demand values in the forward reduced demand table for the same user demand input values.

8. The method of claim 1, wherein the output limit includes at least one of an revolutions per minute (RPM) limit to limit a rotational speed of the marine drive and a thrust output limit to limit a thrust output of the marine drive.

9. The method of claim 1, wherein determining the vessel speed of the marine vessel includes measuring vessel speed with a vessel speed sensor.

10. The method of claim 1, wherein determining the vessel speed of the marine vessel includes accessing a pseudo vessel speed table providing vessel speed values based on user demand input values.

11. The method of claim 10, further comprising adapting the pseudo vessel speed table to the marine vessel by storing a measured vessel speed produced at each of a range of user demand inputs.

12. The method of claim 1, further comprising in response to receiving a user input to disengage the quick steer mode, employing a normal steering ratio between positions of the steering wheel and desired steering angles of the marine drive, wherein a larger steering angle change is effectuated in response to a movement of the steering wheel when the reduced steering ratio is employed compared to a steering angle change in response to the movement of the steering wheel when the normal steering ratio is employed.

13. The method of claim 1, further comprising decreasing a number of permitted wheel turns lock-to-lock upon engaging the quick steer mode.

14. The method of claim 1, further comprising utilizing a proportional integral derivative (PID) controller to compare the vessel speed to the threshold vessel speed and determine the output limit based on the comparison, and wherein controlling the marine drive based on the output limit includes determining a reduced demand based on a user demand input and the output limit.

15. A steering system for a marine vessel, the system comprising:

a steerable marine drive rotatable about a steering axis to desired steering angles;

a steering actuator configured to rotate the marine drive about the steering axis;

a steering wheel rotatable by a user;

a wheel position sensor configured to sense a position of the steering wheel;

a one or more controllers collectively configured to:

in response to receiving a user input to engage a quick steer mode, employ a reduced steering ratio to translate positions of a steering wheel to desired steering angles of a marine drive;

determine a vessel speed of the marine vessel;

compare the vessel speed to a threshold vessel speed;

upon the vessel speed exceeding the threshold vessel speed, determine an output limit to prevent the marine vessel from further exceeding the threshold vessel speed while in the quick steer mode; and control the marine drive based on the output limit and control the steering actuator associated with the marine drive based on the reduced steering ratio the positions of the steering wheel.

16. The system of claim 15, wherein the output limit prevents effectuating a user commanded vessel speed increase only in a direction of travel of the marine vessel.

17. The system of claim 15, wherein the output limit includes a reduced demand to the marine drive in a direction of travel of the marine vessel.

18. The system of claim 17, wherein the reduced demand is a percentage of a user demand input.

19. The system of claim 17, wherein the one or more controllers is further configured to determine the reduced demand based on at least one of a user demand input, a vessel speed, and a direction of travel of the marine vessel.

20. The system of claim 19, wherein the one or more controllers is further configured to determine the reduced demand utilizing a forward reduced demand table when the direction of travel is forward and the user demand input requests a forward demand, and utilizing a reverse reduced demand table when the direction of travel is backward and the user demand input requests a reverse demand; and wherein the forward reduced demand table and the reverse reduced demand table each provide reduced demand values based on user demand input values and wherein the reduced demand values in the reverse reduced demand table are greater than the reduced demand values in the forward reduced demand table for the same demand input values.

21. The system of claim 15, wherein the one or more controllers is further configured to, in response to receiving a user input to disengage the quick steer mode, employ a normal steering ratio between positions of the steering wheel and desired steering angles of the marine drive, wherein a larger steering angle change is effectuated in response to a movement of the steering wheel when the reduced steering ratio is employed compared to a steering angle change in response to the movement of the steering wheel when the normal steering ratio is employed.

22. The system of claim 15, wherein the one or more controllers utilizes proportional integral derivative (PID) controller to compare the vessel speed to the threshold vessel speed and determine the output limit based on the comparison, and wherein controlling the marine drive based on the output limit includes determining a reduced demand based on a user demand input and the output limit.

* * * * *